US006218797B1

(12) United States Patent
Williamson et al.

(10) Patent No.: US 6,218,797 B1
(45) Date of Patent: Apr. 17, 2001

(54) CROSSING GUARD MAINTENANCE SYSTEM AND ASSOCIATED METHOD

(75) Inventors: N. Rodger Williamson, Leesville; Charles R. Drafts, Gilbert, both of SC (US)

(73) Assignee: Union Switch & Signal, Inc., Pittsburgh, PA (US)

( * ) Notice: Subject to any disclaimer, the term of this patent is extended or adjusted under 35 U.S.C. 154(b) by 0 days.

(21) Appl. No.: 09/410,806

(22) Filed: Oct. 1, 1999

(51) Int. Cl.[7] ..... H02P 1/00
(52) U.S. Cl. ..... 318/280; 49/28
(58) Field of Search ..... 318/280, 282, 318/266, 466; 49/25–28, 199; 247/125–129

(56) References Cited

U.S. PATENT DOCUMENTS

| | | | | |
|---|---|---|---|---|
| 3,695,332 | * | 10/1972 | Bahnsen | 160/188 |
| 3,964,704 | * | 6/1976 | Karr | 246/125 |
| 4,090,685 | * | 5/1978 | Pappas | 246/125 |
| 4,115,954 | * | 9/1978 | Larkin et al. | 49/240 |
| 4,624,076 | * | 11/1986 | Schoeman | 49/199 |
| 4,983,949 | * | 1/1991 | Wicker | 340/433 |
| 5,502,367 | | 3/1996 | Jones . | |
| 5,543,596 | * | 8/1996 | Jones et al. | 200/573 |
| 5,747,954 | * | 5/1998 | Jones et al. | 318/266 |
| 5,834,914 | | 11/1998 | Moe et al. . | |
| 5,852,350 | | 12/1998 | Levoir . | |
| 5,884,432 | * | 3/1999 | DeLillo | 49/49 |

* cited by examiner

*Primary Examiner*—Jeffrey Donels
*Assistant Examiner*—Rina I. Duda
(74) *Attorney, Agent, or Firm*—David V. Radack; Kirk D. Houser; Eckert Seamans Cherin & Mellott, LLC

(57) ABSTRACT

A crossing guard maintenance system is disclosed for use with a disabled crossing guard control system. The crossing guard control system has a motor mechanically coupled to a crossing guard arm and a counterweight arm. The motor is used for moving the crossing guard arm between up and down positions. The maintenance system includes a function switch for alternating between normal and maintenance modes of the system. In maintenance mode, a diode is electrically connected to the motor to form a motor/diode circuit that provides a path for current when the polarity of the motor is reversed and it operates as a generator. The maintenance system also includes an electrical power source connected to a momentary switch for providing power to the motor. A method for using the maintenance system is also disclosed for use in repairing a disabled crossing guard mechanism.

12 Claims, 3 Drawing Sheets

CROSSING GUARD MAINTENANCE SYSTEM AND ASSOCIATED METHOD

BACKGROUND OF THE INVENTION

1. Field of the Invention

The present invention generally relates to apparatus and methods employed in conjunction with crossing guard mechanisms. The present invention more particularly relates to use of mechanical and electrical means to enable the safe repair of a crossing guard mechanism, such as a mechanism employed at a railroad crossing.

2. Background Information

It has been known to position crossing guard mechanisms adjacent to certain designated areas to resist the passage of pedestrians, drivers and other individuals into those areas. A crossing guard mechanism positioned adjacent to a locomotive crossing, for example, hinders the unsafe passage of individuals over the railroad tracks when arrival of a train is imminent. Unfortunately, a common problem arises with a crossing guard mechanism when its guard arm is struck by a vehicle, for example, or another disturbance affects the mechanism and the guard arm becomes detached from the mechanism. This event can also adversely affect the control and operating circuitry of the crossing guard mechanism. An example of a highway crossing gate control circuit is provided by U.S. Pat. No. 5,502,367 to Jones, which is incorporated herein in its entirety by reference.

A complication created by this situation is how to move a counterweight arm of the crossing guard mechanism to its "up" or horizontal position in a safe and efficient manner. The counterweight arm is normally employed in a crossing guard mechanism to counterbalance the weight of the guard arm at a common connection point between the two arms. The common connection point provides the mechanical advantage needed to permit the guard arm to be raised and lowered as required. To repair a disabled crossing guard mechanism, the guard arm connection point must be lowered to an accessible position or its "down" position. A connection point on the counterweight arm can then be aligned with a connection point on the guard arm to permit reconnection of the guard arm to the guard mechanism.

Difficulty arises in this situation from the weight of the counterweight arm. The weight of this counterweight arm is proportional to the length of the guard arm and is substantial. The crossing guard system generally becomes unbalanced and disrupted as a result of the unexpected removal of the guard arm. Once the system is unbalanced, substantial mechanical advantage is required to raise the counterweight arm. Furthermore, the operator must be able to raise the counterweight arm in a manner which does not substantially jeopardize his safety and which protects the crossing guard equipment, including its control circuitry, in the event of loss of electrical power to the mechanism while moving the counterweight arm or arms to the "up" position. Without taking protective measures, the counterweight arm can fall in a relatively rapid and uncontrolled manner, possibly endangering the operator and/or causing damage to the crossing guard mechanism.

Maintenance systems have been implemented within crossing guard mechanisms, but these systems generally utilize relatively expensive relays and a number of different components. Many maintenance systems are included within and connected to the normal control and operating circuitry of the crossing guard mechanism. This interdependence between the maintenance system and the usual crossing guard functions inherently lowers the reliability of the normal function of the mechanism.

What is needed therefore are a maintenance system and an associated method which provide safety and reliability advantages that are not obtainable in other designs that rely on a constant source of electrical power to engage relatively complex components such as electromechanical brakes or relays, for example. What is also needed are a maintenance system and an associated method that can be performed simply and reliably to service a crossing guard mechanism. Furthermore, a maintenance system and method are needed that are substantially independent from the operation of the electrical control and operation circuitry of the crossing guard system.

SUMMARY OF THE INVENTION

The present invention provides a crossing guard maintenance system and associated method for use with a crossing guard control system. The crossing guard control system has a motor mechanically coupled to a crossing guard arm and to a counterweight arm or arms to move the arms between their respective up and down positions. This motor is normally electrically connected to the control system, until its polarity is reversed by the maintenance system to provide electrical power for moving the arms. The motor is preferably a permanent magnetic motor.

In the maintenance system of the present invention, a function switch is provided with a "normal" position in which it electrically connects the motor to the crossing guard control system; and, a "maintenance" position in which it energizes the maintenance system of the present invention. This function switch is preferably provided as a double pole double throw switch. A diode is electrically connected to the function switch when in its "maintenance" position. The diode acts as a flyback mechanism to provide a path for current through the motor in the event that the motor becomes a DC generator in a failure mode. Connection of the diode to the motor can be considered to form a motor/diode circuit.

The present invention also discloses a momentary switch that connects the motor/diode circuit to an external electrical power source when the momentary switch is closed. Therefore, when open, the momentary switch does not provide a path for electrical current to flow to the motor/diode circuit; when closed, the momentary switch provides current flow to the motor/diode circuit. The momentary switch can be provided as a pushbutton type switch for alternating between the open and closed positions of the momentary switch. The diode is preferably connected between the motor and the momentary switch to protect the momentary switch from electrical arcs when electrical power supplied to the motor/diode circuit is interrupted by opening the momentary switch.

In addition, the present invention discloses a method for reconnecting a guard arm removed from a crossing guard mechanism having both guard and counterweight arms. The method also includes disconnecting the motor from the crossing guard control system; connecting the motor to a maintenance system as previously described; raising the counterweight arm to an "up" position; maintaining the "up" position of the counterweight arm, such as by use of a lock pin; aligning a common mechanical connection point between the counterweight and guard arms; and, reconnecting the guard arm to the crossing guard mechanism.

Jogging the momentary switch in the method of the present invention is also disclosed for permitting the counterweight arm to be raised after a guard arm failure event. As an additional step, the method of the present invention can include switching the function switch to its "normal" position to resume normal operation of the crossing guard mechanism once maintenance is completed.

It is an object of the present invention to move a counterweight arm of a crossing guard mechanism to its "up" or horizontal position in a safe and efficient manner.

It is an additional object of the present invention to provide substantial mechanical advantage to the crossing guard system by reversing the polarity of the motor employed in the system.

It is an additional object of the present invention to resist injury to an operator performing maintenance on a crossing guard system.

It is an additional object of the present invention to resist damage to the crossing guard system control and operation circuitry.

It is an additional object of the present invention to reduce interdependence between normal crossing guard control and operation functions and the maintenance system to improve the reliability of the control and operation circuitry.

These and other objects of the present invention will be more fully understood from the following description of the invention and by reference to the figures and claims appended hereto.

BRIEF DESCRIPTION OF THE DRAWINGS

A full understanding of the invention can be gained from the following detailed description of the invention when read in conjunction with the accompanying drawings in which.

DESCRIPTION OF THE PREFERRED EMBODIMENT

Figure 1:
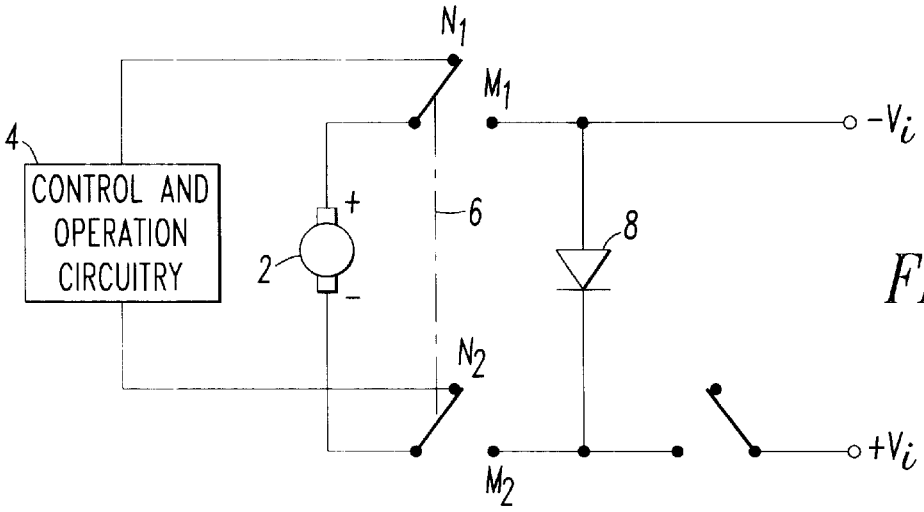
FIG. 1 is a circuit block diagram showing the maintenance system of the present invention in its "normal" position.

Referring now to FIG. 1 of the present invention, a motor 2 is shown which is normally operatively associated with the control and operation circuitry 4 of a crossing guard mechanism (not shown). The motor 2 is preferably a permanent magnet motor and is coupled through a conventional gear train to the crossing guard arm and counterweight arm or arms of the crossing guard mechanism. The positive and negative terminals of the motor 2 are electrically connected to the control and operation circuitry 4 at N1 and N2, respectively. The preferred motor for use in the present invention can be typically rated with the following specifications: a gear motor, $1/6^{th}$ Horsepower, 12 Volts DC, 15 Amps, 30 RPM, and with electric brake. The connection between the motor 2 and the control and operation circuitry 4 is enabled by a function switch 6, which is preferably provided as a double pole, double throw switch. As shown, the function switch 6 is positioned in a "normal" position that provides for the regular functioning of the control and operation circuitry 4 of the crossing guard mechanism. The function switch 6 has two operating positions, namely "normal" and "maintenance" that serve the function of transferring the crossing guard mechanism motor 2 from the control circuitry 4 typically contained within the case (not shown) of the mechanism in the "normal" position and reversing electrical polarity to the motor 2 in the "maintenance" position.

Figure 2:
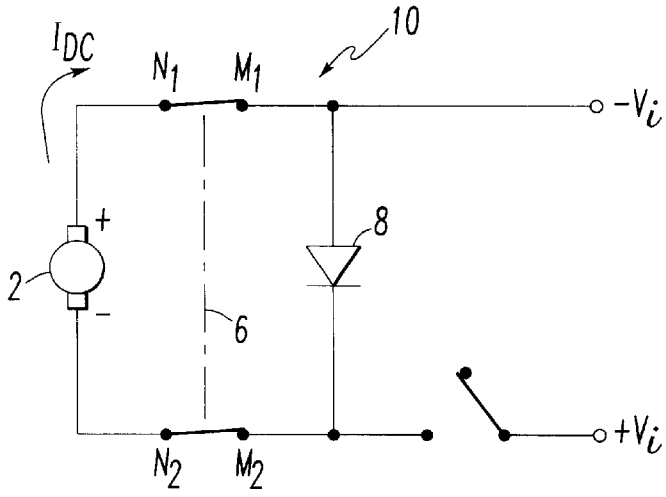
FIG. 2 is a circuit diagram showing the maintenance system of the present invention in its "maintenance" position with the momentary switch open.

Referring now to FIGS. 1 and 2 of the present invention, when maintenance on the crossing guard mechanism is desired, such as after loss of its guard arm or another failure event, the function switch 6 can be switched to its "maintenance" position as shown more particularly in FIG. 2. In the "maintenance" position, the function switch 6 connects with the terminals of a diode 8 as shown at points M1 and M2 and electrically connects the diode 8 to the motor 2. This connection of diode 8 and motor 2 can be considered a motor/diode circuit 10 of the present invention. This diode 8 can be a conventional silicone power diode and can also be any suitable device which provides the flyback and snubbing functions desired by the present invention. It can be appreciated that the diode 8 is selected for use in the present invention to maintain its simplicity of design and to promote improved reliability for the maintenance system.

For example, if a failure event causes electrical power reduction or removal from the control and operation circuitry 4, then the diode 8 acts to provide a path for current, such as current $I_{DC}$, and to resist a motor over-speed condition. The current $I_{DC}$ can be generated when, for example, a counterweight arm of the crossing guard mechanism falls and causes the motor to become a DC generator. This is caused by mechanical coupling of the arm to the motor 2 through a conventional gear train that results in movement of the motor 2 when the arm falls. The motor 2 becomes a DC generator that is mechanically powered by the falling counterweight arm coupled through the crossing guard mechanism gear train. In addition, the diode 8 is connected to the motor 2 with a polarity that provides regenerative braking to the motor 2. Therefore, if a counterweight arm mechanically coupled to the motor 2 falls, for example, during repair procedures performed by a worker, then the motor 2 acts in regenerative braking mode to reduce the rate of the falling arm and this resists motor and gear train damage potentially resulting from a motor over-speed condition. The loss of electrical power can occur, for example, due to a failure of the supplied electrical power such as in the case of a blown fuse or tripped circuit breaker or, as discussed hereinafter, due to the inadvertent opening of a momentary switch prior to inserting a lock pin into the gear train of the mechanism during maintenance procedures.

Figure 3:
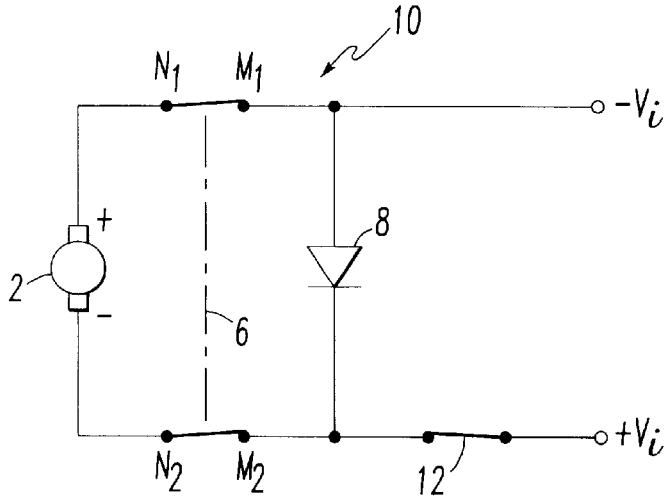
FIG. 3 is a circuit diagram showing the maintenance system of the present invention in its "maintenance" position with the momentary switch closed.

Referring now to FIG. 3, a momentary switch 12 is connected between an electrical power source, shown as $+V_i$ and $-V_i$, and the motor/diode circuit 10. As shown in FIG. 3, the momentary switch 12 is in its closed position supplying electrical power to the motor/diode circuit 10. This power source is preferably a direct current power source and is typically about 0 volts or ground potential for $-V_i$ and from about 11 to 16 volts for $+V_i$. The power source permits the polarity of the motor 2 to be reversed and the motor 2 to be used as an apparatus for lowering a crossing guard arm connection point into its proper position for mechanical reconnection of the crossing guard arm.

The momentary switch 12 preferably is a push-button type switch for convenience of alternating between open and closed positions and for deterring the operator from using the switch 12 as the sole locking device during maintenance operations. This "jogging" or alternated on and off switching permits stepped or discrete amounts of current to be transmitted to the motor 2 during operation of the maintenance system. The momentary switch 12 is preferably maintained normally in an open position.

Referring again to FIGS. 1 through 3, it can be appreciated that the diode is connected between the motor 2 and the momentary switch 12 to protect the contacts of the momentary switch 12 from electrical arcing when power supplied to the motor/diode circuit 10 is interrupted by opening the momentary switch 12. The addition of the momentary switch 12 reduces the possibility of motor stall and overheating while the operator reconnects the guard arm of the crossing guard mechanism. It can be appreciated that, once the required maintenance is completed, positioning the function switch 6 to its "normal" position reconnects the control and operation circuitry 4 contained within the case of the crossing guard mechanism to the motor 2. In addition, switching to this "normal" position disconnects the maintenance system of the present invention from the control and operating circuitry 4.

In another embodiment of the present invention, a method for reconnecting a guard arm removed from a crossing guard mechanism is provided. The method is for use with the control system of a crossing guard mechanism that is electrically connected to a permanent magnet DC motor. The motor of the crossing guard mechanism is mechanically coupled through a gear train to both a crossing guard arm and a counterweight arm or arms. The motor is used to raise and lower the arms as needed when the mechanism is activated to resist movement of a person or vehicle, for example, across or into a designated area. The preferred method is employed in conjunction with a crossing guard system having a guard arm and at least one counterweight arm normally in a down position to counteract the weight of the guard arm.

Figure 4:
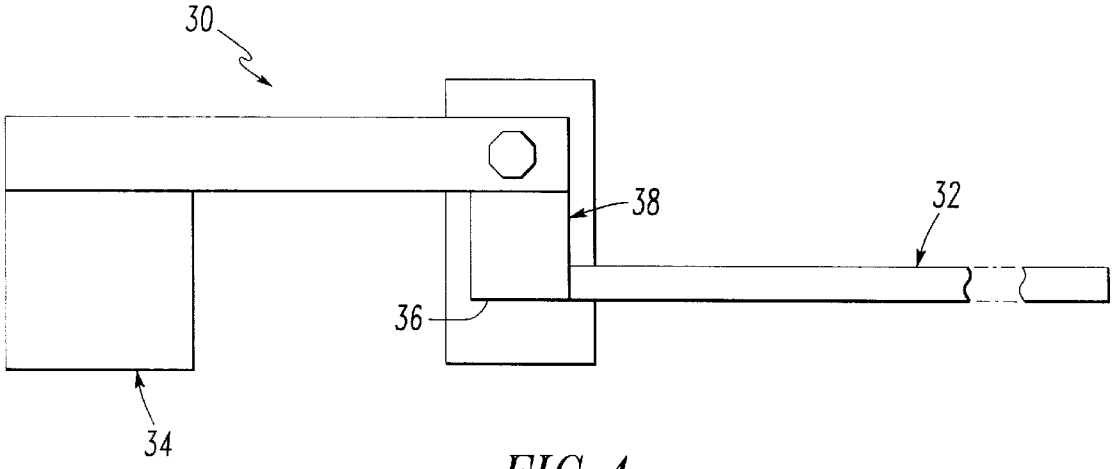
FIG. 4 is a schematic view of a crossing guard mechanism with its counterweight arm in the "up" position.
Figure 5:
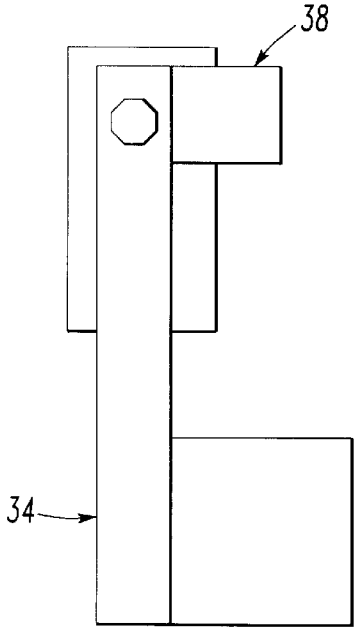
FIG. 5 is a schematic view of FIG. 4 showing the counterweight arm in its "down" position.

Referring now to FIGS. 4 and 5, the respective "up" and "down" positions of the guard arm and the counterweight arm of a typical crossing guard system 30 are shown.

As shown in FIG. 4, the crossing guard arm 32 is in its "down" or restrictive position. In this position, the guard arm 32 is used to block passage or access to a restricted area such as a portion of a railway. Also as shown, the counterweight arm 34 is in its "up" position to provide the additional potential energy that will be necessary to raise the guard arm 32 when the crossing guard system 30 is activated. The counterweight arm 34 is mechanically connected to the guard arm 32 through a portion 36 of the counterweight arm 34 having a common connection point 38 for attachment of the guard arm 32 thereto.

As shown in FIG. 5, the counterweight arm 34 is in its "down" position after the loss of the guard arm (not shown) such as by an automobile striking the guard arm, for example, or a similar failure event. The connection point 38 for the guard arm has now been rotated approximately ninety degrees from its original orientation to a position which is relatively difficult for a maintenance person to access.

The maintenance method of the present invention therefore begins with an operator or other maintenance worker disconnecting the motor from the electrical control and operation system circuitry. This step ensures that no electrical power is supplied to the motor by the control system during maintenance on the crossing guard mechanism.

Next the motor is electrically connected to a maintenance circuit as substantially described herein. As previously discussed, the maintenance circuit includes a function switch which is preferably a double pole, double throw switch having two positions. In a "normal" position the function switch electrically connects the motor to the control system of the crossing guard mechanism. In a "maintenance" position of the function switch, a diode is electrically connected to the motor to form a motor/diode circuit. The motor/diode circuit provides a path for current to flow when the motor is operated as a generator, on its own or by an external power source.

The maintenance system employed by the method of the present invention also includes an electrical power source connected to a momentary switch that is connected between the power source and the motor/diode circuit. The momentary switch has a first open position in which electrical power is not supplied to the motor/diode circuit and a second closed position in which electrical power is supplied to the motor/diode circuit to reverse the polarity of the motor. In one aspect of the method of the present invention, "jogging" the momentary switch can be used to raise the counterweight arm. The "jogging" step permits an external power source to provide energy to the motor/diode circuit for reversing polarity on the motor thereby turning the motor in a direction opposite of its normal rotation. Therefore, the "jogging" step supplies power to the motor, which in turn helps the operator to raise the guard arm of the mechanism.

Figure 6:
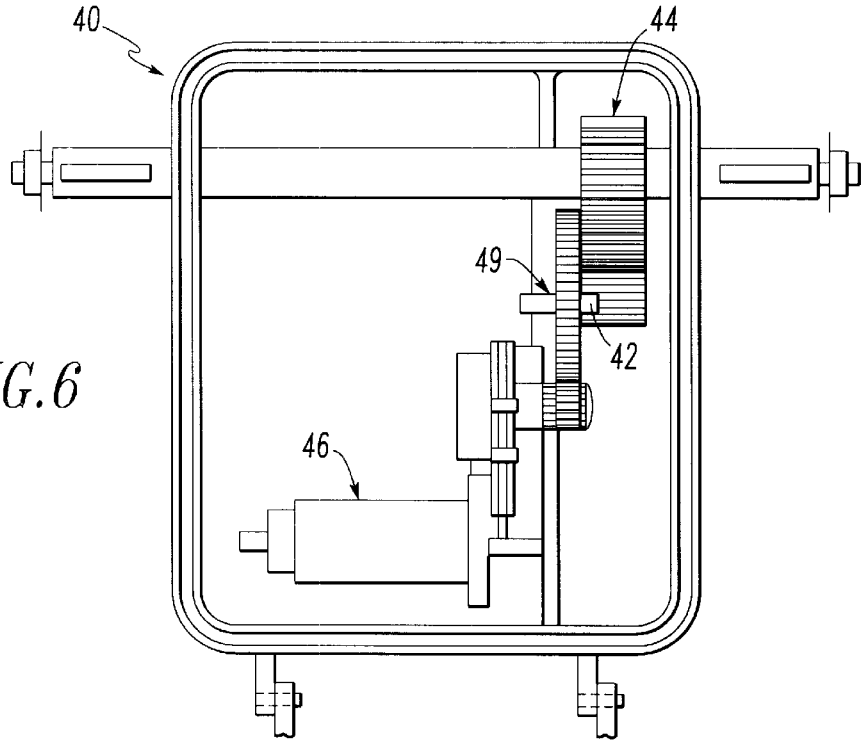
FIG. 6 is a schematic partially cut-away front view of a portion of a crossing guard mechanism; and, FIG. 7 is a side view of FIG. 6.
Figure 7:
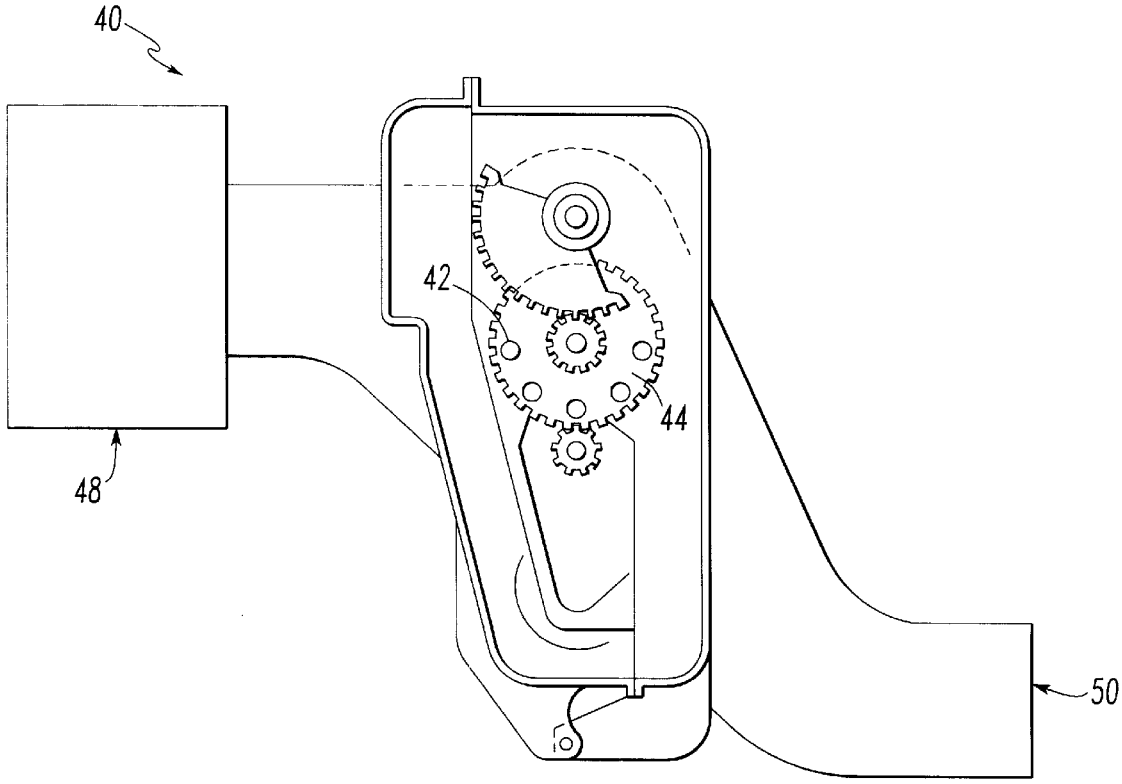

The method of the present invention also includes raising the counterweight arm of the crossing guard mechanism to an "up" position and then maintaining the "up" position of the counterweight arm. Referring now to FIGS. 6 and 7, the maintaining step can include positioning a lock pin 42 or another suitable apparatus into the gears 44 coupled to the motor 46 of the crossing guard mechanism 40 to resist the counterweight arm 48 from performing a controlled descent to its "down" position during maintenance procedures. The lock pin 42 extends through suitably located and dimensioned holes in the gears 44 and a corresponding hole in a case wall 49. The gears 44 are provided for raising and lowering the arms in the crossing guard system. The lock pin 42 provides a mechanical means to secure the counterweight arm 48 or arms in the "up" position by resisting gear movement and thereby permitting removal of electrical power by using the momentary switch as previously discussed herein.

Referring again to FIG. 7, the method then includes aligning a common connection point 50 between the counterweight arm 48 and the disconnected guard arm (not shown) and then reconnecting the guard arm to the crossing guard system 40. Once the guard arm has been reconnected, switching the function switch to its "normal" position resumes normal operation of the crossing guard mechanism.

The present invention provides safety and reliability features which are satisfied by other conventional designs which rely on a constant source of electrical power to engage complicated components such as electromechanical brakes or relays. The significant advantages of the present invention are inherent in its simplicity and reliability of the implementation. The implementation of the present invention relies primarily on switches and other basic devices such as the silicon diode. The present invention also does not employ electrical power to activate devices such as electromechanical relays that require periodic calibration or brake coils that are prone to failure events including open circuit failures, for example. Furthermore, the elements included in the maintenance system of the present invention are employed independently from the electrical control and operation circuitry used by the crossing guard mechanism during normal functioning.

Whereas certain terms of relative orientation such as "up" and "down" have been used for purposes of illustration of the present invention, these terms are not intended to limit the scope of the present invention. In addition, whereas particular embodiments of this invention have been described above for purposes of illustration, it will be evident to those skilled in the art that numerous variations of the details of the present invention may be made without departing from the invention as defined in the appended claims.

What is claimed is:

1. A crossing guard maintenance system for use with a crossing guard control system having a motor mechanically coupled to a crossing guard arm for moving said crossing guard arm between up and down positions, said motor also being normally electrically connected to said control system, said crossing guard maintenance system comprising:

a. a function switch having a first position, which electrically connects said motor to said control system, and having a second position:

b. a diode electrically connected in the second position of said function switch to said motor to form a motor/diode circuit such that said diode provides a path for current in said motor/diode circuit when said motor operates as a generator;

c. an electrical power source; and, d. a momentary switch connected between said power source and said motor/diode circuit, said momentary switch having a first open position in which electrical power is not supplied to said motor/diode circuit and a second closed position in which electrical power is supplied to said motor/diode circuit to reverse the polarity of said motor.

2. The system of claim 1 wherein said function switch is a double pole double throw switch.

3. The system of claim 1, wherein said momentary switch is a pushbutton type switch for alternating between said first open and said second closed positions of said momentary switch.

4. The system of claim 1, wherein said diode is a silicone power diode.

5. The system of claim 1, wherein said motor is a permanent magnetic motor.

6. The system of claim 1, wherein said motor has a positive input and a negative input; wherein said diode has an anode and a cathode; and wherein the anode of said diode is electrically connected to the positive input of said motor and the cathode of said diode is electrically connected to the negative input of said motor in the second position of said function switch to protect said momentary switch when said electrical power supplied to said motor/diode circuit is interrupted by opening said momentary switch.

7. The system of claim 1, wherein said motor has a positive input and a negative input; wherein said diode has an anode and a cathode; and wherein the anode of said diode is electrically connected to the positive input of said motor and the cathode of said diode is electrically connected to the negative input of said motor in the second position of said function switch.

8. A method for reconnecting a guard arm removed from a crossing guard mechanism having a control system electrically connected to a motor for raising and lowering said guard arm and also having at least one counterweight arm normally in a down position to counteract the weight of said guard arm, comprising:

a) disconnecting said motor from said control system;

b) connecting said motor to a maintenance circuit including:

(i) a function switch, in a first position, electrically connecting said motor to said control system;

(ii) a diode electrically connected in a second position of said function switch to said motor to form a motor/diode circuit such that said diode provides a path for current in said motor/diode circuit when said motor operates as a generator;

(iii) an electrical power source; and, (iv) a momentary switch connected between said power source and said motor/diode circuit, said momentary switch having a first open position in which electrical power is not supplied to said motor/diode circuit and a second closed position in which electrical power is supplied to said motor/diode circuit to reverse the polarity of said motor;

c) raising said counterweight arm to an up position;

d) maintaining said up position of said counterweight arm;

e) aligning a common connection point between said counterweight arm and said guard arm; and, f) reconnecting said guard arm.

9. The method of claim 8, further including jogging said momentary switch for raising said counterweight arm.

10. The method of claim 8, wherein said maintaining step includes positioning a lock pin in a gear train of said crossing guard mechanism to resist said counterweight arm from descending.

11. The method of claim 8, further including switching said function switch to its said first position for resuming normal operation of said crossing guard mechanism.

12. The method of claim 8, further including employing said motor with a positive input and a negative input; employing said diode with an anode and a cathode; and electrically connecting the anode of said diode with the positive input of said motor and electrically connecting the cathode of said diode with the negative input of said motor in the second position of said function switch.

* * * * *